US008295498B2

(12) United States Patent
Karlsson et al.

(10) Patent No.: US 8,295,498 B2
(45) Date of Patent: Oct. 23, 2012

(54) APPARATUS AND METHOD FOR PRODUCING 3D AUDIO IN SYSTEMS WITH CLOSELY SPACED SPEAKERS

(75) Inventors: Erlendur Karlsson, Uppsala (SE); Patrik Sandgren, Stockholm (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 771 days.

(21) Appl. No.: 12/412,072

(22) Filed: Mar. 26, 2009

(65) Prior Publication Data

US 2009/0262947 A1 Oct. 22, 2009

Related U.S. Application Data

(60) Provisional application No. 61/045,353, filed on Apr. 16, 2008.

(51) Int. Cl.
*H04R 29/00* (2006.01)

(52) U.S. Cl. ..... 381/56; 381/17; 381/309; 381/63

(58) Field of Classification Search ..... 381/56, 381/17, 309, 63
See application file for complete search history.

(56) References Cited

U.S. PATENT DOCUMENTS

| | | | |
|---|---|---|---|
| 3,236,949 | A | 2/1966 | Atal |
| 4,893,342 | A | 1/1990 | Cooper et al. |
| 4,910,779 | A | 3/1990 | Cooper et al. |
| 4,975,954 | A | 12/1990 | Cooper et al. |
| 5,034,983 | A | 7/1991 | Cooper et al. |
| 5,136,651 | A | 8/1992 | Cooper et al. |
| 5,333,200 | A | 7/1994 | Cooper et al. |
| 5,757,931 | A | 5/1998 | Yamada et al. |
| 6,009,178 | A | 12/1999 | Abel et al. |
| 6,424,719 | B1 | 7/2002 | Elko et al. |
| 6,668,061 | B1 | 12/2003 | Abel |
| 2004/0179693 | A1 | 9/2004 | Abel |
| 2007/0076892 | A1 | 4/2007 | Kim |

FOREIGN PATENT DOCUMENTS

| | | | |
|---|---|---|---|
| EP | 0833302 | A2 | 4/1998 |
| EP | 1194007 | A2 | 4/2002 |
| EP | 1225789 | A2 | 7/2002 |
| WO | 01/39548 | A1 | 5/2001 |
| WO | 2006/056661 | A1 | 6/2006 |
| WO | 2006/076926 | A2 | 7/2006 |

OTHER PUBLICATIONS

Schroeder, M. R. "Models of Hearing." Proceedings of the IEEE, vol. 63, No. 9, Sep. 1975. Schroeder, M. R. et al. "Computer Simulation of Sound Transmission in Rooms." IEEE International Convention Record, vol. 7, Mar. 1963, pp. 150-155.

Cooper, D. H. et al. "Prospects for Transaural Recording." J. Audio Eng. Soc., vol. 37, No. 1/2, Jan./Feb. 1989, pp. 3-19.

Ward, D. B. et al. "Effect of Loudspeaker Position on the Robustness of Acoustic Crosstalk Cancellation." IEEE Signal Processing Letters, vol. 6, No. 5, May 1999, pp. 106-108.

Ward, D. B. et al. "Virtual Sound Using Loudspeakers: Robust Acoustic Crosstalk Cancellation." Chapter 14 of Acoustic Signal Processing for Telecommunication. Copyright 2000 by Kluwer Academic Publishers. Second Printing 2001.

Laakso, T. I. et al. "Splitting the Unit Delay." IEEE Signal Processing Magazine, Jan. 1996, pp. 30-60.

*Primary Examiner* — Samuel Gebremariam

(74) *Attorney, Agent, or Firm* — Coats & Bennett, P.L.L.C.

(57) ABSTRACT

An audio processing circuit includes a crosstalk cancellation circuit that is advantageously simplified for use in audio devices that have closely-spaced speakers. In particular, crosstalk filtering as implemented in the circuit assumes that the external head-related contralateral filters are time-delayed and attenuated versions of the external, head-related ipsilateral filters. With this assumption, the circuit's crosstalk filtering is configurable for varying audio characteristics, according to a small number of settable parameters. These parameters include configurable first and second attenuation parameters for cross-path signal attenuation, and configurable first and second delay parameters for cross-path delay. Optional sound normalization, if included, uses similar simplified parameterization. Further, in one or more embodiments, the audio processing circuit and method include or are associated with a defined table of parameters that are least-squares optimized solutions. The optimized parameter values provide wider listening sweet spots for a greater variety of listeners.

20 Claims, 7 Drawing Sheets

APPARATUS AND METHOD FOR PRODUCING 3D AUDIO IN SYSTEMS WITH CLOSELY SPACED SPEAKERS

RELATED APPLICATIONS

This application claims priority under 35 U.S.C. §119(e) from the U.S. Provisional Application Ser. No. 61/045,353, as filed on 16 Apr. 2008 and entitled "Acoustic Crosstalk Cancellation for Closely Spaced Speakers," and which is incorporated herein by reference.

TECHNICAL FIELD

The present invention generally relates to audio signal processing, and particularly relates to audio signal processing for delivering 3D audio (e.g., binaural audio) to a listener through audio devices with closely-spaced speakers.

BACKGROUND

A binaural audio signal is a stereo signal made up of the left and right signals reaching the left and right ear drums of a listener in a real or virtual 3D environment. Streaming or playing a binaural signal for a person through a good pair of headphones allows the listener to experience the immersive sensation of being inside the real or virtual environment, because the binaural signal contains all of the spatial cues for creating that sensation.

In real environments, binaural signals are recorded using small microphones that are placed inside the ear canals of a real person or an artificial head that is constructed to be acoustically equivalent to that of the average person. One application of streaming or playing such a binaural signal for another person through headphones is to enable that person to experience a performance or concert almost as "being there."

In virtual environments, binaural signals are simulated using mathematical modeling of the acoustic waves reaching the listener's eardrums from the different sound sources in the listener's environment. This approach is often referred to as 3D audio rendering technology and can be used in a variety of entertainment and business applications. For example, gaming represents a significant commercial application of 3D audio technology. Game creators build immersive 3D audio experiences into their games for enhanced "being there" realism.

However, use of 3D audio rendering technology goes well beyond gaming. Commercial audio and video conferencing systems may employ 3D audio processing in an attempt to preserve spatial cues in conferencing audio. Further, many types of home entertainment systems use 3D audio processing to simulate surround sound effects, and it is expected that new commercial applications of 3D environments (virtual worlds for shopping, business, etc.) will more fully use 3D audio processing to enhance the virtual experience.

Conventionally, the reproduction of reasonably convincing sound fields, with accurate spatial cueing, during playback of 3D audio relies on significant signal processing capabilities, such as those found in gaming PCs and home theater receivers. (References to "3D audio" in this document can be understood as referring specifically to binaural audio with its discrete left and right ear channels, and more generally to any audio intended to create a spatially-cued sound field for a listener.)

Delivery of a binaural signal to a listener through headphones is straightforward, because the left binaural signal is delivered directly to the listener's left ear and the right binaural signal is delivered directly to the listener's right ear. However, the use of headphones is sometimes inconvenient and they isolate the listener from the surrounding acoustical environment. In many situations that isolation can be restricting. Because of those disadvantages, there is great interest in being able to deliver binaural and other 3D audio to listeners using a pair of external loudspeakers.

To appreciate the difficulty involved in delivering such audio, FIG. 1 illustrates an overall loudspeaker transmission system 10 from two loudspeakers 12L and 12R to the eardrums 14L and 14R of a listener 16. The diagram depicts the natural filtering of the loudspeaker signals $S_L$ and $S_R$ on their way to the listener's left and right ear drums 14L and 14R. The sound wave signal $S_L$ from the left speaker 12L is filtered by the ipsilateral head related (HR) filter $H_I(\omega)$ before reaching the left ear drum 14L and by the contralateral HR filter $H_C(\omega)$ before reaching the right ear drum 14R. Corresponding filtering occurs for the right loudspeaker signal $S_R$.

The main problem with the illustrated signal transmission system 10 is that there are crosstalk signals from the left loudspeaker to the right ear and from the right loudspeaker to the left ear. As a further problem, the HR filtering of the direct term signals by the ipsilateral filters $H_I(\omega)$ colors the spectrum of the direct term signals. The equations below provide a complete description of the left and right ear signals in terms of the left and right loudspeaker signals:

$$E_L(\omega) = H_I(\omega)S_L(\omega) + \underbrace{H_C(\omega)S_R(\omega)}_{\text{Crosstalk right speaker to left ear}}, \quad \text{Eq. (1)}$$

and $$E_R(\omega) = \underbrace{H_C(\omega)S_L(\omega)}_{\text{Crosstalk right speaker to left ear}} + H_I(\omega)S_R(\omega), \quad \text{Eq. (2)}$$

where $E_L$ and $E_R$ are the left and right ear signals, respectively, and $S_L$ and $S_R$ are the left and right loudspeaker signals, respectively.

If a left binaural signal $B_L$ was transmitted directly from the left speaker 12L and a right binaural signal $B_R$ was transmitted directly from the right speaker 12R, the signals at the listener's ears would be given by $$E_L(\omega)=H_I(\omega)B_L(\omega)+H_C(\omega)B_R(\omega), \quad \text{Eq. (3)}$$

and $$E_R(\omega)=H_C(\omega)B_L(\omega)+H_I(\omega)B_R(\omega). \quad \text{Eq. (4)}$$

These actual left and right ear signals are much different from the desired left and right ear signals, which are $$E_L(\omega)=e^{-j\omega\tau}B_L(\omega), \quad \text{Eq. (5)}$$

and $$E_R(\omega)=e^{-j\omega\tau}B_R(\omega). \quad \text{Eq. (6)}$$

Where $\tau$ is a given, system-dependent time delay.

In Eq. (3) and Eq. (4), the spatial audio information originally present in the binaural signals is partly destroyed by the head related filtering of the direct-path terms. However, the main degradation is caused by the crosstalk signals. With crosstalk, the signals reaching each of the listener's ears are a mix of both the left and right binaural signals. That mixing of left and right binaural signals completely destroys the perceived spatial audio scene for the listener.

However, the desired left/right ear signals as given in Eq. (5) and Eq. (6) can be obtained, or nearly so, by filtering and mixing the binaural signals before transmission by the loudspeakers 12L and 12R to the listener 16. FIG. 2 illustrates a known approach to filtering and mixing binaural signals in advance of loudspeaker transmission, providing the listener 16 with left/right ear signals more closely matching the desired left/right ear signals.

In the diagram, a prefilter and mixing block 20 precedes the loudspeakers 12L and 12R. The illustrated prefiltering and mixing block 20 is often called a crosstalk cancellation block and is well known in the literature. It includes a left-to-left direct-path filter 22L and a right-to-right direct-path filter 22R. Each direct-path filter 22 implements a direct-term filtering function denoted as $P_D$. The block further includes a left-to-right cross-path filter 24L and a right-to-left cross-path filter 24R. Each cross-path filter 24 implements a cross-path filtering function denoted as $P_X$.

With these prefilters and their illustrated interconnections, a left-path combiner 26L mixes the left direct-path signal together with the right-to-left cross-path signal, and the right-path combiner 26R mixes the right direct-path signal together with the left-to-right cross-path signal. From the diagram, it is easily seen that the left ear signal $E_L$ is given by:

$$\begin{aligned} E_L(\omega) &= H_I(\omega)S_L(\omega)S_R(\omega) \\ &= H_I(\omega)(P_D(\omega)B_L(\omega) + P_X(\omega)B_R(\omega)) + H_C(\omega)(P_X(\omega)B_L(\omega) + P_D(\omega)B_R(\omega)) \\ &= \frac{(H_I(\omega)P_D(\omega) + H_C(\omega)P_X(\omega))}{R_D(\omega)} B_L(\omega) + \frac{(H_I(\omega)P_X(\omega) + H_C(\omega)P_D(\omega))}{R_X(\omega)} B_R(\omega). \end{aligned} \quad \text{Eq. (7)}$$

Symmetric results are obtained for the right ear signal $E_R$.

To obtain the desired binaural signal transmissions specified in Eq. (5) and Eq. (6), the direct-path transfer function $R_D(\omega)$ from $B_L$ to $E_L$ needs to satisfy:

$$R_D(\omega)=H_I(\omega)P_D(\omega)+H_C(\omega)P_X(\omega)=e^{-j\omega\tau}, \quad \text{Eq. (8)}$$

and the cross-path transfer function $R_X(\omega)$ from $B_R$ to $E_L$ must satisfy:

$$R_X(\omega)=H_I(\omega)P_X(\omega)+H_C(\omega)P_D(\omega)=0. \quad \text{Eq. (9)}$$

Eq. (8) and Eq. (9) can be used to obtain a general purpose solution for the direct-path filter $P_D$ and the cross-path filter $P_X$. Such solutions are well known in the literature, but their implementation requires relatively sophisticated signal processing circuitry.

In an increasingly mobile world, however, more and more audio playback occurs on devices that have limited signal processing capabilities and great sensitivity to overall power consumption. Perhaps more significantly, such devices commonly have fixed speakers that generally are very closely spaced together (e.g., 30 cm or less). For example, mobile terminals, computer audio systems (especially for laptops/palmtops), and many teleconferencing systems use loudspeakers positioned within close proximity to each other. Because of their limited processing capabilities and their close speaker spacing, the recreation of spatial audio by such devices is particularly challenging.

SUMMARY

The apparatuses and methods described in this document focus on the recreation of spatial audio using devices that have closely-spaced loudspeakers. By using approximations that are made possible by the assumption of closely-spaced loudspeakers, this document presents an audio processing solution that provides crosstalk cancellation and optional sound image normalization according to a small number of configurable parameters. The configurability of the disclosed audio processing solution and its simplified implementation allows it to be easily tailored for a desired balance between audio processing performance and the signal processing and power consumption limitations present in a given device.

More particularly, the teachings presented in this document disclose an audio processing circuit having a prefilter and mixer solution that provides crosstalk cancellation and optional sound image normalization, while offering a number of advantages over more complex audio processing circuits. These advantages include but are not limited to: (a) parameterization with very few parameters that are easily adjusted to handle different loudspeaker configurations, where the reduced number of parameters still provide good acoustic system modeling; (b) reduction in sensitivity to variations in HR filters and the listening position, as compared to solutions based on full scale parametric models, which provides a wider listening sweet spot and corresponding sound delivery that works well for a larger listener population; (c) implementation scalability and efficiency; (d) use of stable Finite Impulse Response (FIR) filters; and (e) use of butterfly-type crosstalk cancellation architecture, allowing the crosstalk removal and sound image normalization blocks to be solved and optimized separately.

In one or more embodiments, the audio processing circuit includes a butterfly-type crosstalk cancellation circuit, also referred to as a crosstalk cancellation block. Assuming left and right binaural or other spatial audio signals as the input signals, the crosstalk cancellation circuit includes a first direct-path filter that generates a right-to-right direct-path signal by filtering the right audio signal. A second direct-path filter likewise generates a left-to-left direct-path signal by filtering the left audio signal. Further, a first cross-path filter generates a right-to-left cross-path signal by filtering the right audio signal, and a second cross-path filter generates a left-to-right cross-path signal by filtering the left audio signal.

The crosstalk cancellation circuit also includes first and second combining circuits, where the first combining circuit outputs a crosstalk-compensated right audio signal by combining the right-to-right direct-path signal with the left-to-right cross-path signal. Likewise, the second combining circuit outputs a crosstalk-compensated left audio signal by combining the left-to-left direct-path signal with the right-to-left cross-path signal. The crosstalk-compensated right and left audio signals may be output to left and right speakers, or provided to a sound image normalization circuit (block), that is optionally included in the audio processing circuit. Alternatively, the audio processing circuit may be configured with the sound image normalization block preceding the crosstalk cancellation block.

In either case, the crosstalk cancellation block and sound image normalization block, if included, are advantageously simplified according to a small number of configurable parameters that allow their operation to be configured for the particular audio system characteristics of the device in which it is implemented—e.g., portable music player, cell phone, etc. Based on the closely-spaced speaker assumption, the cross-path filters output the right-to-left and left-to-right cross-path signals as attenuated and time-delayed versions of the right and left input audio signals provided to the direct-path filters. Configurable attenuation and time delay parameters allow for easy tuning of the crosstalk cancellation.

For example, one embodiment of the first cross-path filter provides the right-to-left cross-path signal by attenuating and delaying the right audio signal according to a first configurable attenuation factor $\alpha_R$ and a first configurable delay parameter $\mu_R$. The second cross-path filter provides the left-to-right cross-path signal by attenuating and delaying the left audio signal according to a second configurable attenuation factor $\alpha_L$ and a second configurable delay parameter $\mu_L$.

The cross-path delay parameters $\mu_R$ and $\mu_L$ are specified in terms of the audio signal sample period T and are configured to be integer or non-integer values as needed to suit the audio characteristics of the given system. When both $\mu_R$ and $\mu_L$ are integer values, the delay operations simply involve fetching previous data samples from data buffers and the direct-path filters are unity filters that simply pass through the respective right and left input audio signals as the right-to-right and left-to-left direct-path signals.

However, when either $\mu_R$ or $\mu_L$ is a non-integer value, resampling needs to be performed on at least one of the cross-path input signals. The resampling is typically performed by filtering the input signal with a resampling filter. To obtain a causal and realizable FIR filters for resampling, the FIR filter is delayed by extra M samples and truncated at n=0. This configuration forces a delay of M samples also in the other direct- and cross-path filters. In one or more embodiments proposed in this document, M is a design variable that controls the quality of the resampling operation as well as the extra delay through the cross-talk cancellation block. In at least one embodiment, the FIR filters used for resampling are implemented as delayed and windowed sinc functions.

As a further advantage, non-symmetric processing is provided for in that the left and right attenuation and time delay parameters can be set to different values. However, in systems with symmetric left/right audio characteristics, the left/right parameters generally will have the same value. Also, different sets of attenuation parameters (both left and right) can be used for different frequency ranges, to provide for different compensation over different frequency bands. In at least one embodiment, the audio processing circuit includes or is associated with a stored data table of parameter sets, such that tuning the audio processing circuit for a given audio system comprises selecting the most appropriate one (or ones) of the predefined parameter sets.

Further, in at least one embodiment, the attenuation and delay parameters are configured as parameter pairs calculated via least squares processing as the "best" solution over an assumed range of attenuation and fractional sampling delay values. These least-squares derived parameters allow the same parameter values to be used with good crosstalk cancellation results, over given ranges of speaker separation distances and listener positions/angles. Additionally, different pairs of these least-squares optimized parameters can be provided, e.g., stored in a computer-readable medium such as a look-up table in non-volatile memory, thereby allowing for easy parameter selection and corresponding configuration of the audio processing for a given system.

Similar least squares optimization is, in one or more embodiments, extended to the parameterization of sound image normalization filtering, such that least-squares optimized filtering values for sound image normalization are stored in conjunction with the attenuation and delay parameters. Advantageously, the sound image normalization filters are parameterized according to the attenuation and fractional sampling delay parameters selected for use in crosstalk cancellation processing, and an assumed head related (HR) filtering function.

However, the present invention is not limited to the above summary of features and advantages. Indeed, those skilled in the art will recognize additional features and advantages upon reading the following detailed description, and upon viewing the accompanying drawings.

DETAILED DESCRIPTION

Figure 3:
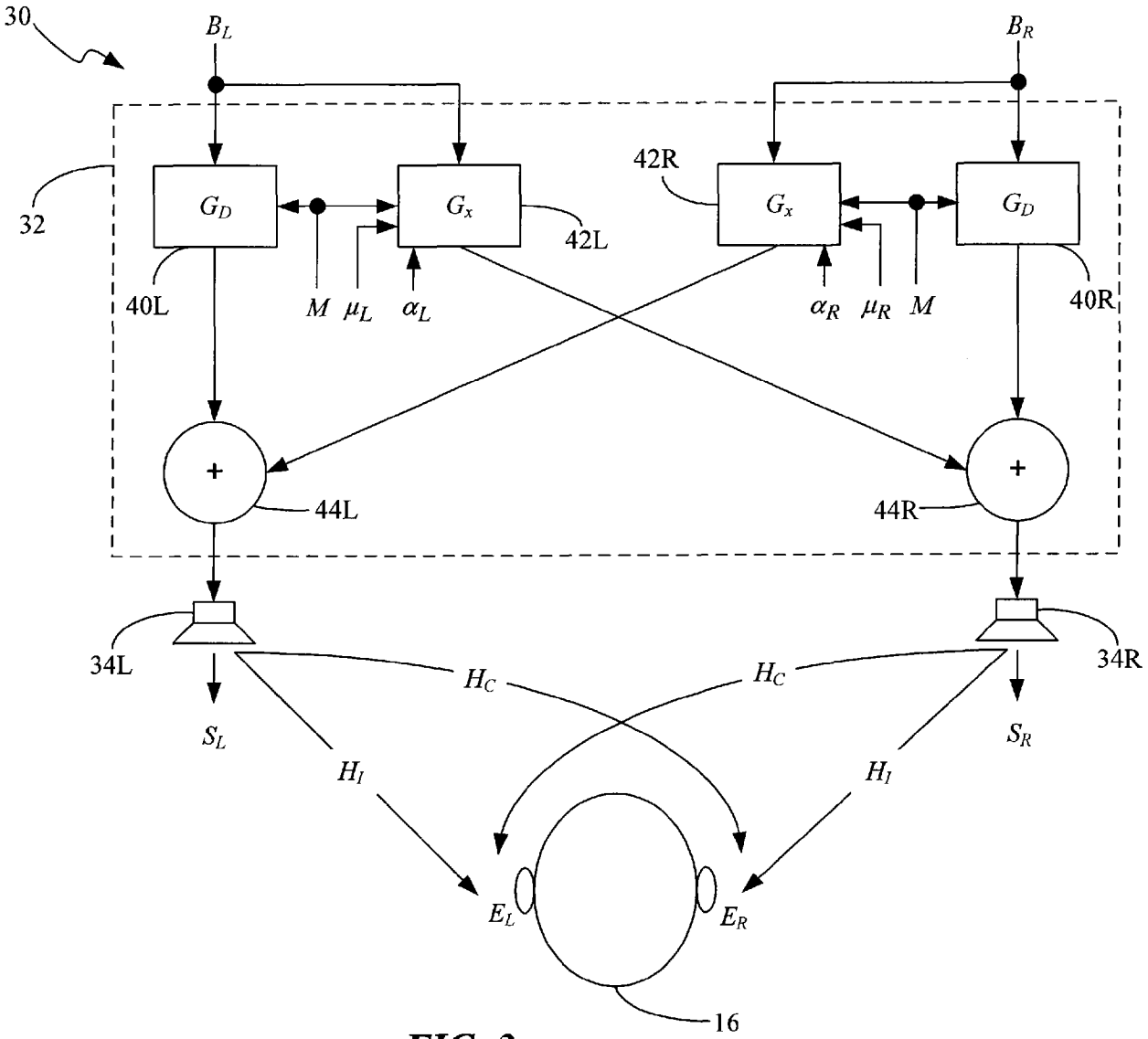
FIG. 3 is a diagram of one embodiment of an audio processing circuit that includes an advantageously-simplified crosstalk cancellation circuit.

FIG. 3 is a simplified diagram of an audio processing circuit 30 that includes an acoustic crosstalk cancellation block 32. Offering advantages in terms of power consumption and computational resource requirements, the crosstalk cancellation block 32 includes a number of implementation simplifications complementing its use in audio devices that have closely-spaced speakers 34R and 34L—e.g., the angle span from the listener to the two speakers should be 10 degrees or less. In particular, the crosstalk cancellation block 32 provides crosstalk cancellation processing for input digital audio signals $B_R$ and $B_L$, based on a small number of configurable attenuation and delay parameters. Setting these parameters to particular numeric values tunes the crosstalk cancellation performance for the particular characteristics of the loudspeakers 34R and 34L.

In one or more embodiments, the parameter values are arbitrarily settable, such as by software program configuration. In other embodiments, the audio circuit 30 includes or is associated with a predefined set of selectable parameters, which may be least-squares optimized values that provide good crosstalk cancellation over a range of assumed and head-related filtering characteristics. In the same or other variations, the audio circuit 30 includes a sound image normalization block positioned before or after the crosstalk cancellation block 32. Sound image normalization may be similarly parameterized and optimized. But, for now, the discussion focuses on crosstalk cancellation and the advantageous, simplified parameterization of crosstalk cancellation that is obtained from the use of closely-spaced loudspeakers.

Crosstalk cancellation as taught herein uses parameterized cross-path filtering. The cross-path delays of the involved cross-path filters are configurable, and are set to integer or non-integer values of the audio signal sampling period T, as needed to configure crosstalk cancellation for a given device application. Resampling is required in a cross-path filter when the delay of that filter $\mu$ is a non-integer value of the underlying audio signal sampling period T. In such cases, the delay is decomposed into an integer component k and a fractional component f, where $0 \leqq f < 1$. The whole sample delay of k samples is implemented by fetching older input signal data samples from a data buffer, while the fractional delay is implemented as a resampling filtering operation with the fractional resample filter $h_r(f,n)$. This fractional resampling is ideally obtained by filtering the input signal with the sinc-function delayed by f, $h_r(f,n)=\mathrm{sinc}(n-f)$.

Figure 4:
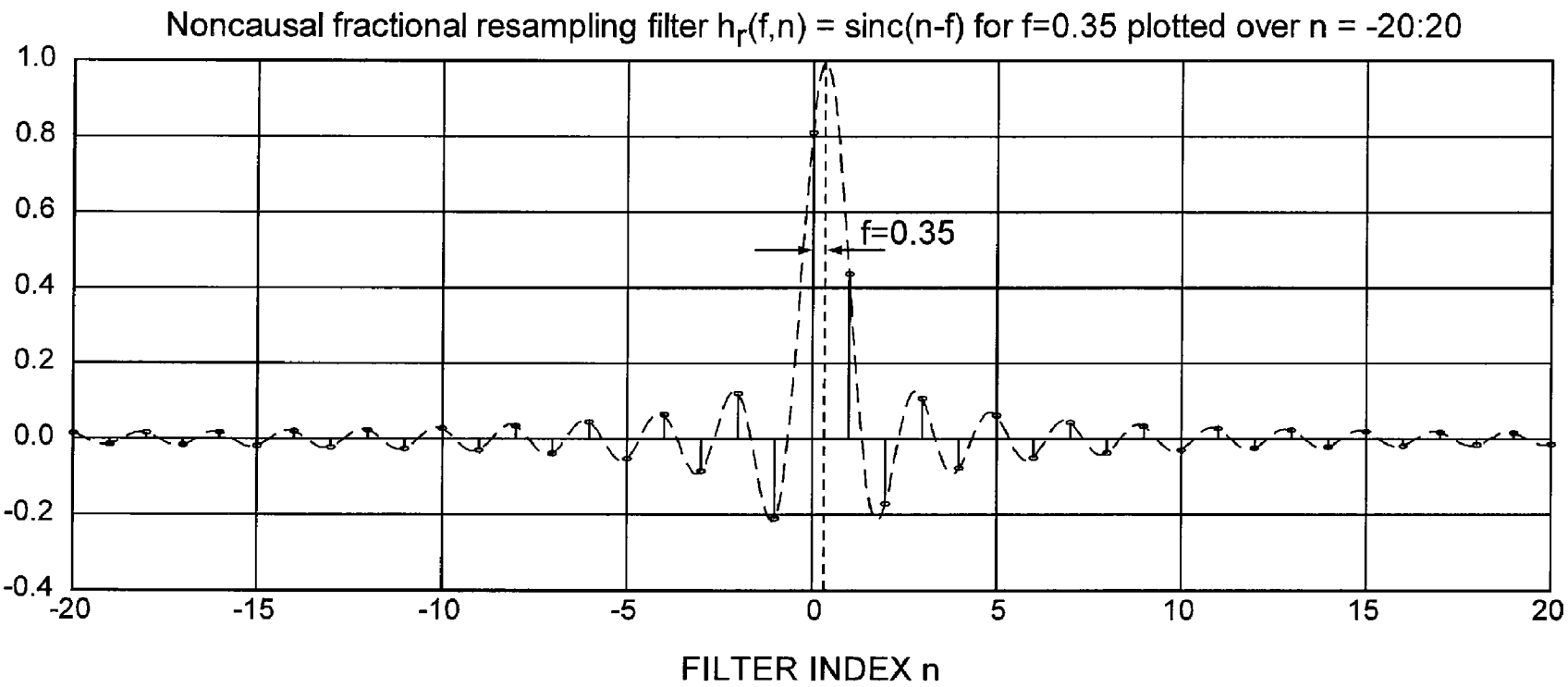
FIG. 4 (PRIOR ART)
FIG. 4 is a diagram of a noncausal filtering function.
Figure 5:
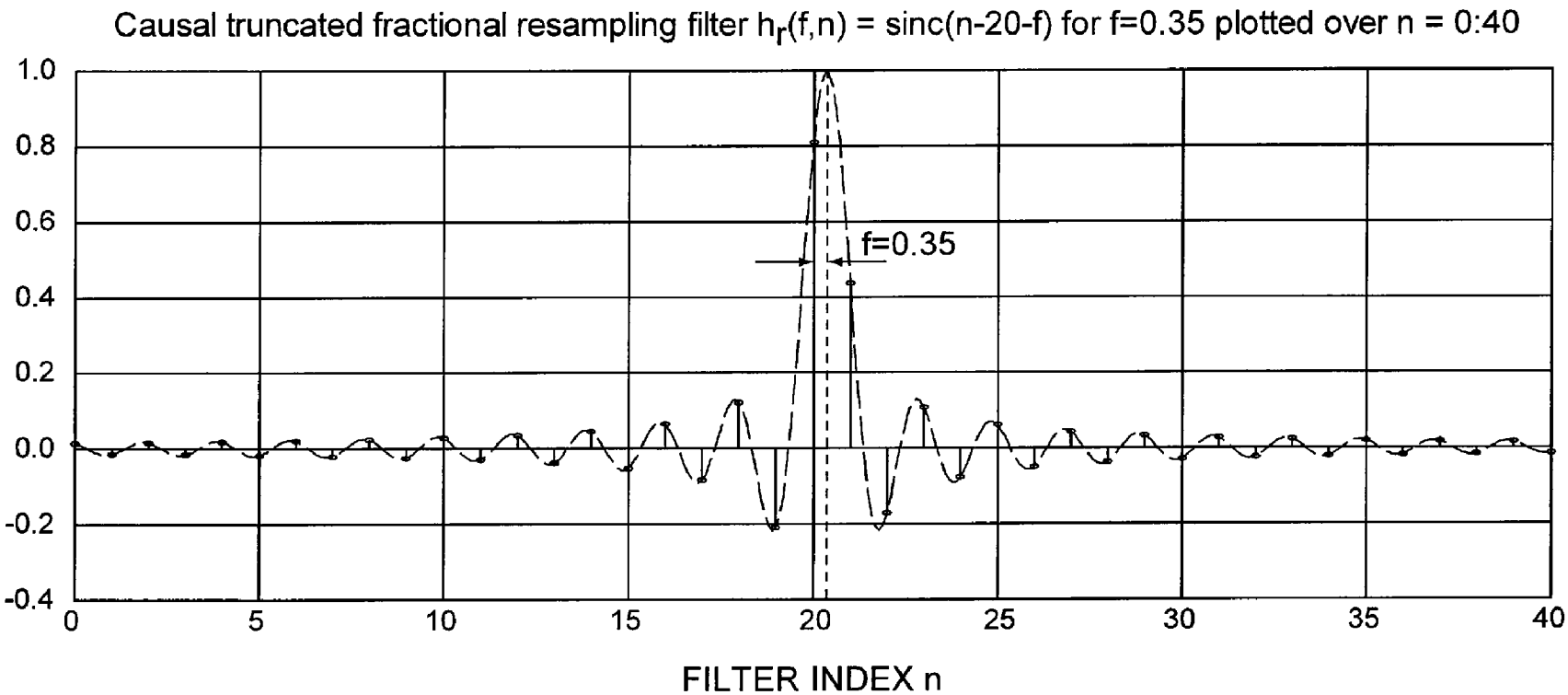
FIG. 5 is a diagram of a causal filtering function, as a realizable implementation of the FIG. 4 filtering, for cross-path delay filtering used in one or more crosstalk cancellation circuit embodiments.

This ideal resampling filter is illustrated in FIG. 4. It is evident from the figure that the ideal resampling filter is noncausal and thus unrealizable. A causal filter is required for a realizable implementation of the filtering operation, which is obtained by delaying the sinc function further by M samples and putting the filter values for negative filter indexes to zero (truncating at filter index 0). FIG. 5 illustrates a practically realizable causal filter function, as is proposed for one or more embodiments of cross-path filtering in the crosstalk cancellation block 32. Note that it is also common practice to window the truncated resampling filter with a windowing function, or to use other specially designed resampling filters.

With the focus on the crosstalk cancellation block in mind, the illustrated embodiment of the crosstalk cancellation block 32 comprises first and second direct-path filters 40R and 40L, first and second cross-path filters 42R and 42L, and first and second combining circuits 44R and 44L. The cross-path filter 42R operation is parameterized according to a configurable cross-path delay value $\mu_R$, and the cross-path filter 42L similarly operates according to the configurable cross-path delay $\mu_L$.

When both $\mu_R$ and $\mu_L$ are integer valued, the direct-path filters 40R and 40L are unity filters, where filter 40R outputs the right audio signal $B_R$ as a right-to-right direct path signal and filter 40L outputs the left audio signal $B_L$ as a left-to-left direct path signal. However, when either $\mu_R$ or $\mu_L$ is a non-integer value, fractional resampling needs to be performed on at least one of the cross-path input signals. As previously explained a causal fractional resampling filter introduces an additional delay of M samples in its path, and the crosstalk cancellation block 32 thus imposes that same delay of M samples in the other direct- and cross-path filters. Thus, in at least one embodiment, M is a configurable design variable that controls the quality of the block's resampling operations, as well as setting the extra delay through the cross-talk cancellation block.

In any case, for right-to-left crosstalk cancellation, the first cross-path filter 42R receives the right audio signal $B_R$ and its filter $G_X$ outputs $B_R$ as an attenuated and time-delayed signal referred to as the right-to-left cross-path signal. Similar processing applies to the left audio signal BL, which is output by the $G_X$ filter of the second cross-path filter 42L as a left-to-right cross-path signal.

The first cross-path filter 42R attenuates the right audio signal $B_R$ according to a first configurable attenuation parameter $\alpha_R$. Here, "configurable" indicates a parameter that is set to a particular value for use in live operation, whether that setting occurs at design time, or represents a dynamic adjustment during circuit operation. More particularly, a "configurable" parameter acts as a placeholder in a defined equation or processing algorithm, which is set to a desired value.

Further, as previously detailed, the first cross-path filter 42R also delays the right audio signal $B_R$ according to a first configurable delay parameter $\mu_R$. More particularly, the first cross-path filter 42R imparts a time delay of $(M+\mu_R)$ sample periods T. As noted, T is the underlying audio signal sampling period, and $\mu_R$ is configured to have the integer or non-integer value needed for acoustic crosstalk cancellation according to the given system characteristics. M is set to a non-zero integer value if $\mu_R$ is not an integer. Operation of the second cross-path filter 42L is similarly parameterized according to a second configurable attenuation parameter $\alpha_L$, a second configurable delay parameter $\mu_L$, and M.

With this arrangement, the first combining circuit 44R generates a crosstalk-compensated right audio signal. That signal is created by combining the right-to-right direct-path audio signal from the first direct-path filter 40R with the left-to-right cross-path signal from the second cross-path filter 42L. Correspondingly, the second combining circuit 44L generates a crosstalk-compensated left audio signal. That signal is created by combining the left-to-left direct-path audio signal from the second direct-path filter 40L with the right-to-left cross-path signal from the first cross-path filter 42R. The crosstalk-compensated right and left audio signals are output by the loudspeakers 34R and 34L, respectively, as the audio signals $S_R$ and $S_L$ shown in FIG. 3.

Figure 1:
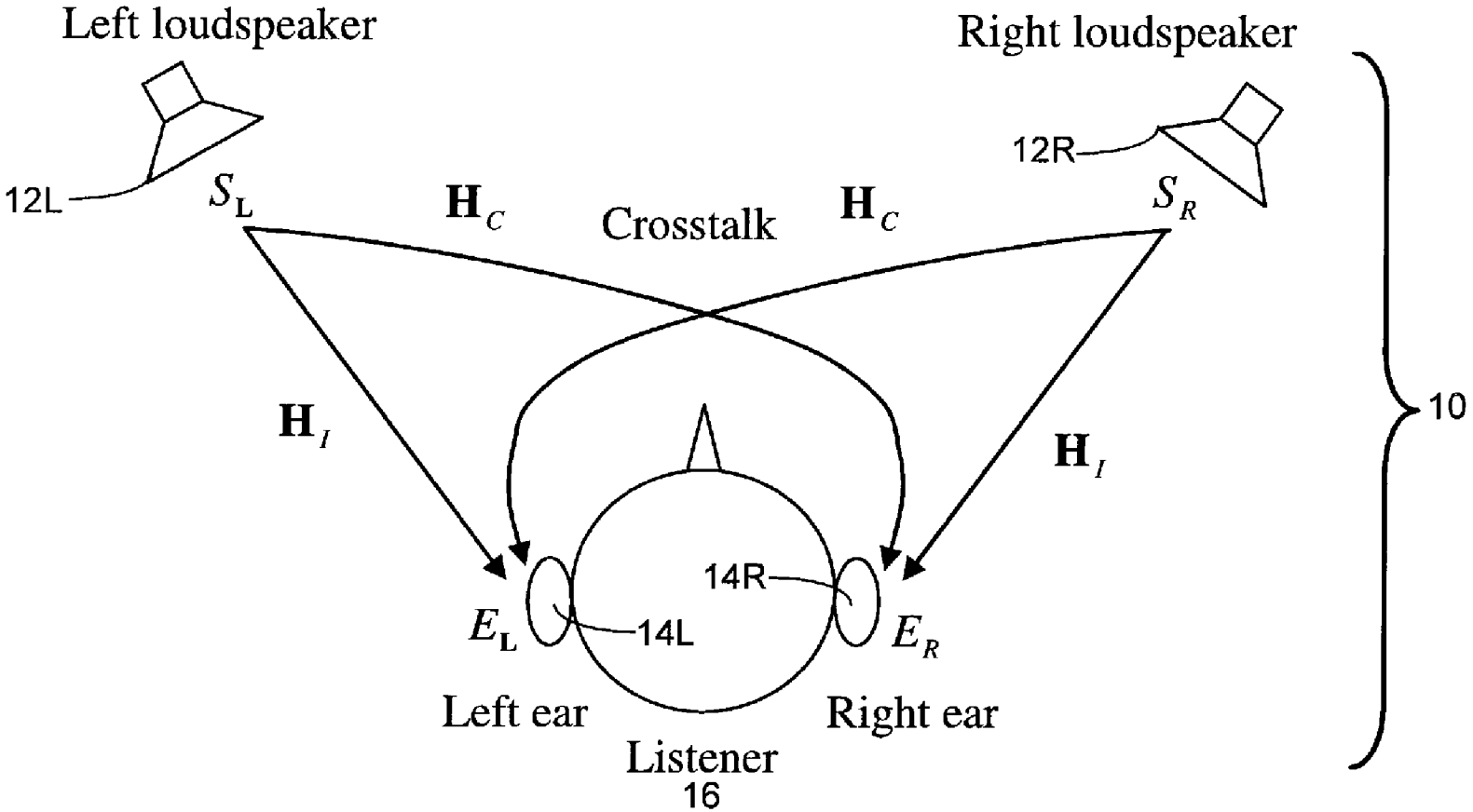
PRIOR ART FIG. 1
FIG. 1 is a block diagram of a conventional pair of loudspeakers that output audio signals not compensated for acoustic crosstalk at the listener's ears.
Figure 2:
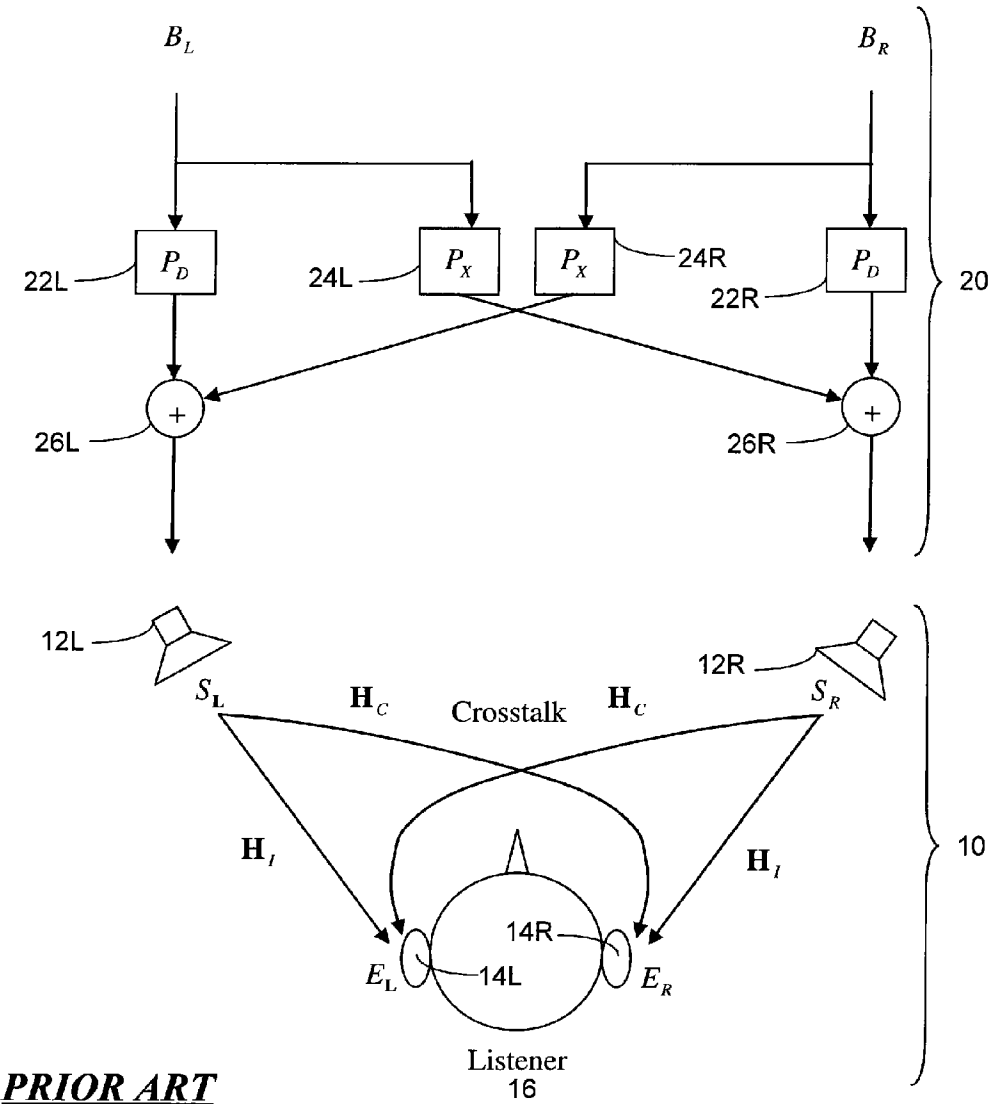
PRIOR ART FIG. 2
FIG. 2 is a diagram of a butterfly-type crosstalk cancellation circuit that uses conventional, fully-modeled crosstalk filter implementations to output loudspeaker signals that are compensated for acoustic crosstalk at the listener's ears.

The parameters of crosstalk cancellation block 32 are configured to have numeric values that at least approximately yield the desired right ear and left ear signals for the listener 16. From the background of this document, the desired right ear and left ear signals are $$E_R(\omega)=e^{-j\omega\tau}B_R(\omega), \quad \text{Eq. (10)}$$

and $$E_L(\omega)=e^{-j\omega\tau}B_L(\omega), \quad \text{Eq. (11)}$$

for a given time delay $\tau$. To obtain these desired ear signals it was required that the cross-path transfer function $R_X(\omega)$ from $B_R$ to $E_L$ and $B_L$ to $E_R$ must satisfy:

$$R_X(\omega)=H_I(\omega)P_X(\omega)+H_C(\omega)P_D(\omega)=0, \quad \text{Eq. (12)}$$

and that the direct-path transfer function $R_D(\omega)$ from $B_L$ to $E_L$ and $B_R$ to $E_R$ needs to satisfy:

$$R_D(\omega)=H_I(\omega)P_D(\omega)+H_C(\omega)P_X(\omega)=e^{-j\omega\tau}, \quad \text{Eq. (13)}$$

where $P_D$ and $P_X$ are the prefilters in the prefilter and mixing block 20 in FIG. 2.

Figure 6:
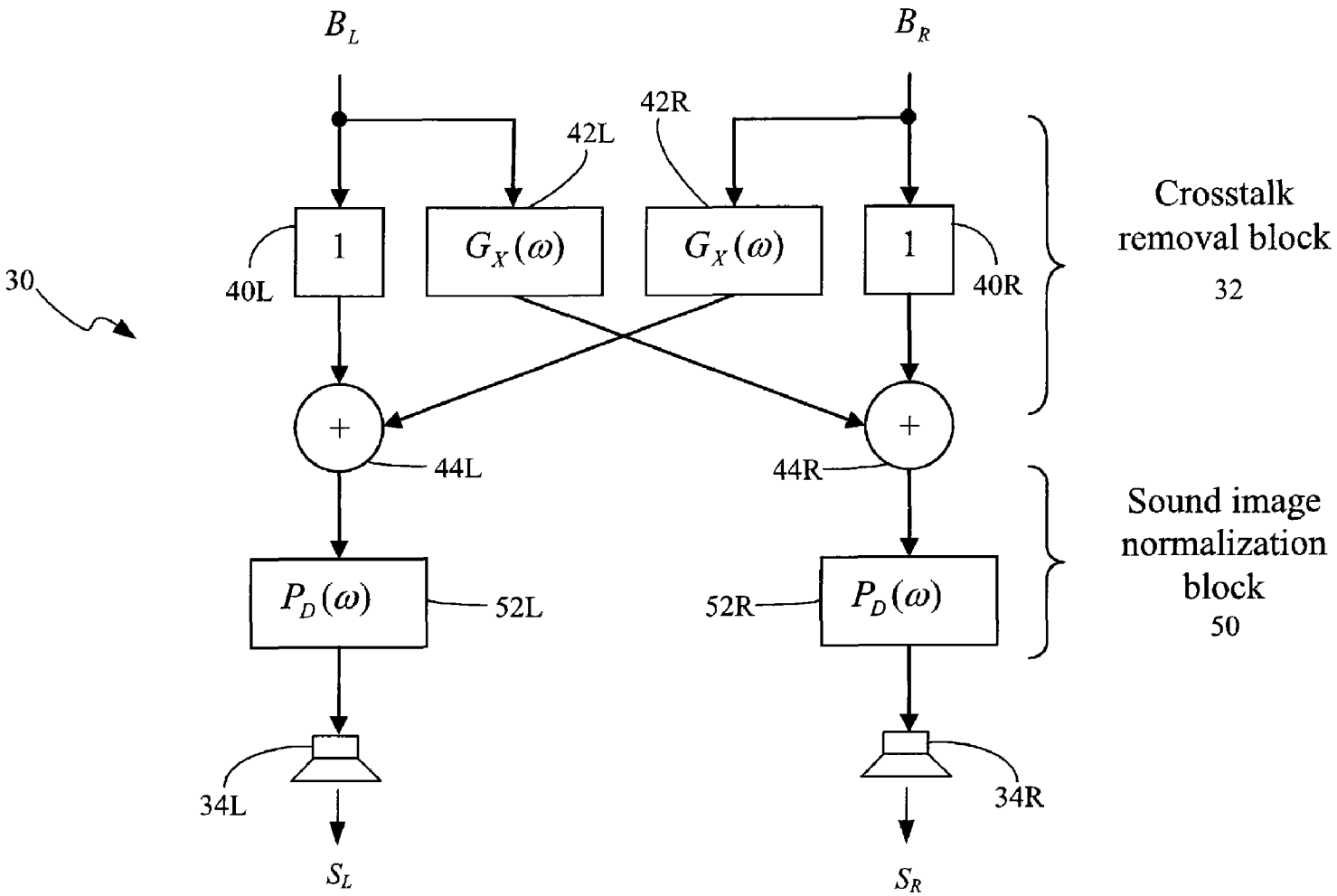
FIG. 6 is a block diagram of an embodiment of an audio processing circuit that includes a crosstalk cancellation circuit and a sound image normalization circuit.

By factoring $P_X$ as $$P_X(\omega)=G_X(\omega)P_D(\omega) \quad \text{Eq. (14)}$$

it is seen that the lattice structured prefilter and mixing block 20 arrangement of FIG. 2 can be implemented as the butterfly structured prefilter and mixing block shown in FIG. 6. Assuming that the loudspeakers 32R and 32L are closely spaced, $H_C(\omega)$ can be approximated as a slightly attenuated and delayed $H_I(\omega)$:

$$H_C(\omega)\approx\alpha e^{-j\omega\mu}H_I(\omega). \quad \text{Eq. (15)}$$

Inserting the factorization of $P_X$ in Eq. (14) and the approximation of $H_I(\omega)$ in Eq. (15) into the expression for $R_X(\omega)$ in Eq. (12), $R_X(\omega)$ becomes:

$$\begin{aligned} R_X(\omega) &= H_I(\omega)P_X(\omega) + H_C(\omega)P_D(\omega) \quad \text{Eq. (16)} \\ &\approx H_I(\omega)G_X(\omega)P_D(\omega) + \alpha e^{-j\omega\mu}H_I(\omega)P_D(\omega) \\ &= H_I(\omega)P_D(\omega)(G_X(\omega) + \alpha e^{-j\omega\mu}) \\ &= 0, \end{aligned}$$

which results in the requirement:

$$G_X(\omega)=-\alpha e^{-j\omega\mu}. \quad \text{Eq. (17).}$$

The above expression is the cross-path filter solution used in the disclosed crosstalk cancellation block 32, as shown in the block diagram of FIG. 3. That is, $\alpha$ represents the configurable attenuation parameter used by cross-path filters 42R and 42L in the crosstalk cancellation block 32, while $\mu$ represents the configurable delay parameter used by those filters. Those skilled in the art will appreciate that the first and second configurable attenuation parameters $\alpha_R$ and $\alpha_L$—and the first and second configurable delay parameters $\mu_R$ and $\mu_L$—can be set to different numeric values, to account for left/right audio asymmetry. Thus, the numeric values used to parameterize Eq. (17) can be different for the first and second cross-path filters 42R and 42L.

By using the cross-path filtering block as given in Eq. (17), only the cross-path transfer function $R_X(\omega)$ will be approximately zero. The desired direct-path transfer function $R_D(\omega)$ then becomes:

$$R_D(\omega) = H_I(\omega)P_D(\omega) + H_C(\omega)P_X(\omega) \quad \text{Eq. (18)}$$
$$\approx H_I(\omega)P_D(\omega) - \alpha^2 e^{-j\omega 2\mu} H_I(\omega)P_D(\omega)$$
$$= H_I(\omega)(1 - \alpha^2 e^{-j\omega 2\mu})P_D(\omega)$$
$$= e^{-j\omega\tau}.$$

Obtaining this desired direct-path transfer function, $R_D(\omega)$, requires that:

$$H_I(\omega)(1-\alpha^2 e^{-j\omega 2}\mu)P_D(\omega)-e^{-j\omega\tau}=0. \quad \text{Eq. (19)}$$

Ignoring left/right subscripts, solving the above equation for a given set of parameters $\alpha$, $\mu$ and $H_I$, yields:

$$P_D(\omega) = \frac{e^{-j\omega\tau}}{H_I(\omega)(1 - \alpha^2 e^{-j\omega 2\mu})}, \quad \text{Eq. (20)}$$

In Eq. (20), it will be understood that $\alpha$ represents the configurable cross-path attenuation parameter for the crosstalk cancellation block 32, $\mu$ similarly represents the configurable cross-path delay parameter, and $H_I(\omega)$ represents an assumed HR ipsilateral filter.

The above solution results in a relatively small listening "sweet spot" that may work well for only a small number of listeners, because the solution depends on a specific pair of $\alpha$ and $\mu$, and a specific head related filter $H_I$. However, one or more embodiments of the audio processing circuit 30 obtain a wider listening sweet spot that works well for a larger listener population, based on finding a $P_D$ that minimizes the error in Eq. (19), over a range of $\alpha$'s, $\mu$'s and a representative set of HR filters. For example, least squares processing is used to find $P_D$. Note that although the solution derivation was presented in the continuous time domain, its actual implementation in the audio processing circuit 30 is in the discrete time domain.

In the discrete time domain time, delays that are not integer multiples of the sampling period require resampling of the input signals to the cross-path filters 42R and 42L of the crosstalk cancellation block 32, which explains why the crosstalk cancellation block 32 is configurable to use, as needed, whole-sample time delays for cross-path filtering ($\mu$=integer value and M=0), or to use non-whole sample time delays for cross-path filtering ($\mu$=non-integer value, M=non-zero integer value).

In either case, in view of the above derived solutions, the crosstalk cancellation block 32 can be understood as advantageously simplifying crosstalk cancellation by virtue of its simplified direct-path and cross-path filtering. Broadly, then, in one or more embodiments, the audio processing circuit 30 parameterizes its crosstalk cancellation processing according to first and second configurable attenuation parameters, and according to first and second configurable delay parameters. These delay parameters are used to express the cross-path delays needed for good acoustic crosstalk cancellation at the listener's position in terms of the audio signal sampling period T.

If the cross-path delay parameters $\mu_R$ and $\mu_L$ are both configured as integer values—i.e., as whole-sample multiples of T—the cross-path filters 42R and 42L can impart the needed cross-path delays simply by using shifted buffer samples of the right and left input audio signals. That is, the audio processing circuit 30 can simply feed buffer-delayed values of the audio signal samples through the cross-path filter 42R and 42L. However, if one or both of the cross-path delay parameters $\mu_R$ and $\mu_L$ are configured as non-integer values—i.e., as non-whole sample multiples of T—the first and second cross-path filters 42R and 42L operate as time-shifted (and truncated) sinc filter functions that achieve the needed fractional cross-path delay by resampling the input audio signal(s).

Thus, in one or more embodiments, the first and second cross-path filters 42R and 42L are FIR filters, each implemented as a windowed sinc function that is offset from the discrete time origin by M whole sample times of the audio signal sampling period T, as needed to enable causal filtering. And, for overall signal processing delay symmetry, the first and second unity-gain filters comprising the direct-path filters 40R and 40L each impart a signal delay of M whole sample times to their respective input signals. That is, if M is non-zero, the direct-path filters impart a delay of M whole sample times T to the direct-path signals.

As a further point of configuration, the audio processing circuit 30 in one or more embodiments is configured to set a filter length of the FIR filters according to a configurable filter length parameter. The filter length setting allows for a configuration trade-off between processing/memory requirements and filtering performance. These and other advantages offer significant flexibility to the designers of mobile audio devices, by providing the ability to tune the audio processing circuit 30 as needed for a given system design.

Of course, part of any such tuning involves setting or otherwise selecting the particular numeric values to use for the audio processing circuit's audio processing parameters, e.g., its $\alpha_R$, $\alpha_L$, $\mu_R$, $\mu_L$ cross-path attenuation and delay parameters. As a further point of flexibility, it was previously noted that the numeric values set for these parameters can differ between the left side and the right side, which allows the audio processing circuit 30 to be tuned for applications that do not have left/right audio symmetry. Of course, corresponding ones of the left/right side parameters can be set to the same values, for symmetric applications.

Figure 7:
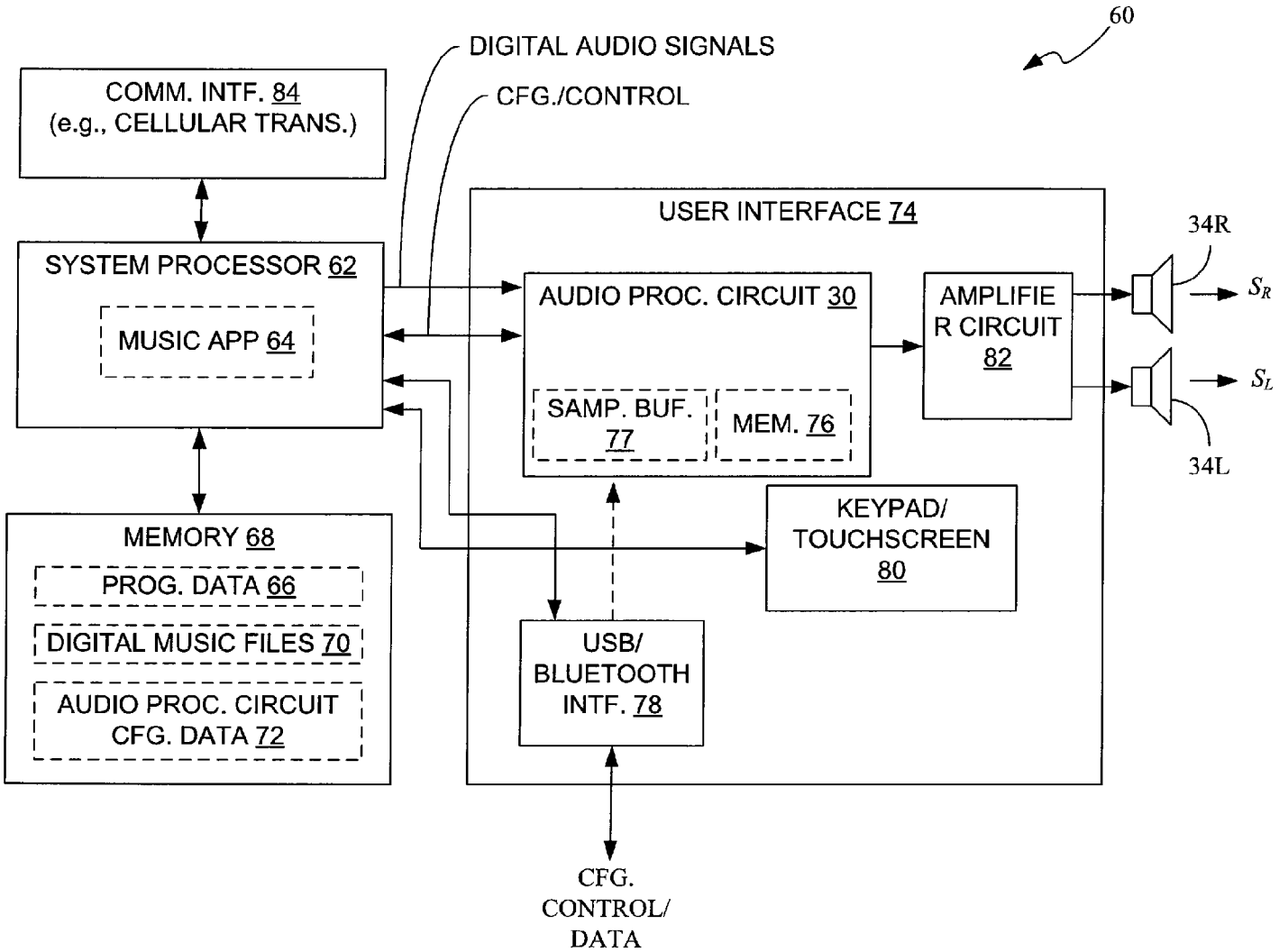
FIG. 7 is a block diagram of an embodiment of an electronic device that includes an audio processing circuit for crosstalk cancellation and, optionally, sound image normalization.

FIG. 7 illustrates one embodiment of a portable audio device 60, which may be a portable digital music player, a music-enabled cellular telephone, or essentially any type of electronic device with digital music playback capabilities. In any case, the device 60 includes a system processor 62, which may be a configurable microprocessor. The system processor 62 runs a music application 64, based on, for example, executing stored program instructions 66 held in a non-volatile memory 68. That memory, or another computer-readable medium within the device 60, also holds digital music data, such as MP3, AAC, WMA, or other types of digital audio files.

The memory 68 also store audio processing circuit configuration data 72, for use by an embodiment of the audio processing circuit 30, which may be included in a user interface portion 74 of the device 60. Additionally, or alternatively, the audio processing circuit 30 may include its own memory 76, and that memory can include a mix of volatile and non-volatile memory. For example, the audio processing circuit 30 in one or more embodiments includes SRAM or other working memory, for buffering input audio signal samples, implementing its filtering algorithms, etc. It also may include non-volatile memory, such as for holding preconfigured sets of configuration parameters.

For example, in at least one embodiment, the memory 76 of the audio processing circuit 30 holds sets of configuration parameters in a table or other such data structure, where those parameter sets represent optimized values, obtained through least-squares or other optimization, as discussed for Eq. (19) and Eq. (20) above. In such embodiments, "programming" the audio processing circuit 30 comprises a user—e.g., the device designer or programmer—selecting the configuration parameters from the audio processing circuit's onboard memory.

However, in one or more other embodiments, such parameters are provided in electronic form, e.g., structured data files, which can be read into a computer having a communication link to the audio processing circuit 30, or at least to the device 60. In such embodiments, the audio processing circuit 30 is configured by selecting the desired configuration parameter values and loading them into the memory 68 or 76, where they are retrieved for use in operation.

In yet other embodiments, the audio processing circuit 30 is infinitely configurable, in the sense that it, or its host device 60, accepts any values loaded into by the device designer. This approach allows the audio processing circuit 30 to be tunable for essentially any device, at least where the closely-spaced speaker assumption holds true. Also, note that the audio processing circuit 30 may include one or more data buffers 77, for buffering samples of the input audio signals—e.g., for causal, FIR filtering, and other working operations. Alternatively, the one or more data buffers 77 may be implemented elsewhere in the functional circuitry of the device 60, but made available to the audio processing circuit 30 for its use.

In any of these embodiments, the audio processing circuit 30 (or the device 60) may be configured to operate modally. For example, the audio processing circuit 30 may operate in a configuration mode, wherein the values of its configuration parameters are loaded or otherwise selected, and may operate in a normal, or "live" mode, wherein it performs the audio processing described herein using its configured parameter values. Regardless, it will be understood that, in various embodiments, or as needed or desired, the audio processing circuit 30 may be configured by placing it in a dedicated test/communication fixture, or by loading it in situ. In at least one such embodiment, the audio processing circuit 30 is configured by providing or selecting its configuration parameters through a USB/Bluetooth interface 78—or other type of local communication interface. Further, in at least one embodiment, it is configurable through user I/O directed through a keypad/touchscreen 80.

However configured, in operation the audio processing circuit 30 receives digital audio signals from the system processor 62—e.g., the $B_R$ and $B_L$ signals shown in FIG. 3—and processes according to its crosstalk cancellation block 32 and optional sound image normalization block 50. The processed audio signals are then passed to an amplifier circuit 82, which generally includes digital-to-analog converters for the left and right signals, along with corresponding analog signal amplifiers suitable for driving the speakers 34R and 34L.

Wireless communication embodiments of the device 60 also may include a communication interface 84, such as a cellular transceiver. Further, those skilled in the art will appreciate that the illustrated device details are not limiting. For example, the device 60 may omit one or more of the illustrated functional circuits, or add others not shown, in dependence on its intended use and sophistication. Moreover, it should be understood that the audio processing circuit 30 may, in one or more embodiments, be integrated into the system processor 62. That particular embodiment is advantageous where the system processor 62 provides sufficient excess signal processing resources to implement the digital filtering of the audio processing circuit 30. In similar fashion, the communication interface 84 may include as sophisticated baseband digital processor, for modulation/demodulation and signal decoding, and it may provide sufficient excess processing resources to implement the audio processing circuit 30.

However, whether implemented in standalone or integrated embodiments, and whether implemented in hardware, software, or some combination of the two, those skilled in the art will appreciate that the audio processing circuit 30 comprises all or part of an electronic processing machine, which receives digital audio samples and transforms those samples into crosstalk-compensated digital samples, with optional sound image normalization. The transformation results in a physical cancellation of crosstalk in the audio signals manifesting themselves at the listener's ears.

Broadly, then, the audio processing circuit 30 as taught herein includes a crosstalk cancellation circuit 32 that is advantageously simplified for use in audio devices that have closely-spaced speakers. In particular, crosstalk filtering as implemented in the circuit 30 assumes that the external head-related contralateral filters are time-delayed and attenuated versions of the external, head-related ipsilateral filters. With this assumption, the circuit's crosstalk filtering is configurable for varying audio characteristics, according to a small number of settable parameters. These parameters include configurable cross-path signal attenuation parameters, and configurable cross-path delay parameters.

Optional sound normalization, if included in the circuit 30, uses similar simplified parameterization. Further, in one or more embodiments, the audio processing circuit 30 includes or is associated with a defined table of parameters that are least-squares optimized solutions. The optimized parameter values provide wider listening sweet spots for a greater variety of listeners.

Accordingly, the present embodiments are to be considered in all respects as illustrative and not restrictive, and all changes coming within the meaning and equivalency range of the appended claims are intended to be embraced therein.

What is claimed is:

1. An audio processing circuit configured to provide acoustic crosstalk cancellation for left and right audio signals, said audio processing circuit including a crosstalk cancellation circuit comprising:

a first direct-path filter configured to receive a right input audio signal and output it as a right-to-right direct-path signal, and a second direct-path filter configured to receive a left input audio signal and output it as a left-to-left direct-path signal;

a first cross-path filter configured to receive the right input audio signal and output it as a right-to-left cross-path signal having an attenuation set by a first configurable attenuation parameter and a time delay set by a first configurable delay parameter, and a second cross-path filter configured to receive the left input audio signal and output it as a left-to-right cross-path signal having an attenuation set by a second configurable attenuation parameter and a time delay set by a second configurable delay parameter; and a first combining circuit configured to output a crosstalk-compensated right audio signal by combining the right-to-right direct-path signal with the left-to-right cross-path signal, and a second combining circuit configured to output a crosstalk-compensated left audio signal by combining the left-to-left direct-path signal with the right-to-left cross-path signal.

2. The audio processing circuit of claim 1, wherein the audio processing circuit includes or is associated with a non-volatile memory circuit storing a range of attenuation parameters and a range of fractional sampling delay parameters, and wherein the audio processing circuit is configured to use selected values from the stored ranges of attenuation and fractional sampling delay parameters as the first and second configurable attenuation and delay parameters, thereby tuning audio processing of the audio processing circuit for a particular speaker configuration.

3. The audio processing circuit of claim 1, wherein the first and second configurable attenuation and delay parameters are least-squares solutions that minimize the norms of the right-to-left and left-to-right cross-path filters for a range of parameter values taken around a given pair of nominal attenuation and delay values and a set of assumed head-related ipsilateral filter functions.

4. The audio processing circuit of claim 1, further comprising a sound image normalization circuit that is configured to normalize the input right and left audio signals for inputting them into the crosstalk cancellation circuit, or configured to normalize the crosstalk-compensated right and left audio signals output by the crosstalk cancellation circuit.

5. The audio processing circuit of claim 4, wherein the sound image normalization circuit is parameterized according to the configurable first and second delay parameters used for the crosstalk cancellation circuit.

6. The audio processing circuit of claim 1, wherein the first and second cross-path filters comprise first and second Finite Impulse Response (FIR) filters, and wherein the first and second direct-path filters comprise first and second unity-gain filters.

7. The audio processing circuit of claim 6, wherein the first and second FIR filters are offset from the discrete time origin by M whole sample times of an audio signal sampling period T of the input right and left audio signals, as needed to enable causal filtering, and wherein for overall signal processing delay symmetry, the first and second unity-gain filters each impart a signal delay of M whole sample times.

8. The audio processing circuit of claim 7, wherein the audio processing circuit is configured to use M=0 if both the first and second configurable delay parameters are set to integer values of the audio signal sampling period T, and to use the value of a third configurable delay parameter for M, if either of the first and second configurable delay parameters is set to a non-integer value of the audio signal sampling period T.

9. The audio processing circuit of claim 7, further comprising a sample buffer configured for buffering samples of the input right and left audio signals, and wherein the first and second FIR filters are configured to resample the left and right input audio signals as needed, to impart cross-path delays that are non-integer values of the audio signal sampling period T.

10. The audio processing circuit of claim 7, wherein the first and second FIR filters comprise configurable-length FIR filters, and wherein the audio processing circuit is configured to set a filter length of the FIR filters according to a configurable filter length parameter.

11. A method of acoustic crosstalk cancellation for left and right audio signals in an audio processing circuit, said method comprising:

generating a right-to-right direct-path signal from a right input audio signal, and generating a left-to-left direct-path signal from a left input audio signal;

generating a right-to-left cross-path signal by attenuating and delaying the right input audio signal according to a first configurable attenuation parameter and a first configurable delay parameter;

generating a left-to-right cross-path signal by attenuating and delaying the left input audio signal according to a second configurable attenuation parameter and a second configurable delay parameter; and generating a crosstalk-compensated right audio signal by combining the right-to-right direct-path signal with the left-to-right cross-path signal, and generating a crosstalk-compensated left audio signal by combining the left-to-left direct-path signal with the right-to-left cross-path signal.

12. The method of claim 11, further comprising setting the first and second configurable attenuation parameters and the first and second configurable delay parameters to values particularized for a given audio application, to thereby tune acoustic crosstalk cancellation for that particular audio application.

13. The method of claim 11, further comprising generating the right-to-right and left-to-left direct-path signals via first and second unity-gain filters, respectively, and generating the right-to-left and left-to-right cross-path signals via first and second Finite Impulse Response (FIR) filters, respectively.

14. The method of claim 11, further comprising storing a range of attenuation parameters and a range of fractional sampling delay parameters, and selecting values from the stored ranges of attenuation and fractional sampling delay parameters as the first and second configurable attenuation and delay parameters, according to a particular speaker configuration.

15. The method of claim 11, further comprising determining the first and second configurable attenuation and delay parameters as least-squares solutions that minimize the norms of the right-to-left and left-to-right cross-path filters for a range of parameter values taken around a given pair of nominal attenuation and delay values, and a set of assumed head-related ipsilateral filtering functions.

16. The method of claim 11, further comprising, if the first and second configurable delay parameters are set to integer values of an audio signal sampling period T associated with the right and left input audio signals, generating the right-to-left and left-to-right cross-path signals by using shifted data samples from a buffer of data samples representing the right and left input audio signals.

17. The method of claim 16, further comprising, if the first and second configurable delay parameters are set to non-integer values of the audio signal sampling period T, generating the right-to-left and left-to-right cross-path signals by resampling data samples from the buffer, according to FIR filters that are parameterized according to the first and second configurable attenuation and delay parameters, wherein the FIR filters are time-shifted by M whole-samples of the audio signal sampling period T for causal filter realization.

18. The method of claim 17, further comprising generating the right-to-right and the left-to-left direct-path signals in first and second unity-gain filters, each imparting a signal delay according to the whole-sample delay M, and setting M to the value of a third configurable delay parameter if the first and second configurable delay parameters are set to non-integer values of the audio signal sampling period T, and otherwise setting M to zero.

19. The method of claim 11, further comprising performing sound image normalization of the input right and left audio signals before crosstalk cancellation, or performing sound image normalization of the right and left crosstalk-compensated signals.

20. The method of claim 19, further comprising implementing the sound image normalization processing in first and second sound image normalization filters that are parameterized according to the first and second configurable attenuation parameters and the first and second configurable delay parameters.

* * * * *

UNITED STATES PATENT AND TRADEMARK OFFICE

CERTIFICATE OF CORRECTION

PATENT NO. : 8,295,498 B2
APPLICATION NO. : 12/412072
DATED : October 23, 2012
INVENTOR(S) : Karlsson et al.

It is certified that error appears in the above-identified patent and that said Letters Patent is hereby corrected as shown below:

In Column 3, Line 22, in Equation (7), delete "$H_I(\omega)S_L(\omega)S_R(\omega)$" and insert -- $H_I(\omega)S_L(\omega)+H_C(\omega)S_R(\omega)$--, therefor.

In Column 9, Line 13, in Equation (19), delete "$H_I(\omega)(1-\alpha^2e^{-j\omega 2}\mu)P_D(\omega)-e^{-j\omega\tau}=0.$" and insert -- $H_I(\omega)(1-\alpha^2e^{-j\omega 2\mu})P_D(\omega)-e^{-j\omega\tau}=0.$ --, therefor.

Signed and Sealed this
Nineteenth Day of February, 2013

Teresa Stanek Rea
*Acting Director of the United States Patent and Trademark Office*